US006021574A

United States Patent [19]

Murray, III

[11] Patent Number: 6,021,574

[45] Date of Patent: Feb. 8, 2000

[54] SCRIBING TOOL

[76] Inventor: William W. Murray, III, 5623 S. 3000 West, Roy, Utah 84067

[21] Appl. No.: 08/964,526

[22] Filed: Nov. 5, 1997

[51] Int. Cl.[7] ..... B41C 1/02; B26D 3/08

[52] U.S. Cl. ..... 33/18.1; 30/164.9; 83/698.71

[58] Field of Search ..... 33/18.1, 18.2, 33/18.3, 19.1, 20.1; 83/698.71, 699.41, 699.61; 30/164.9; 81/9.2

[56] References Cited

U.S. PATENT DOCUMENTS

| | | | |
|---|---|---|---|
| 2,397,109 | 3/1946 | Hedin | 33/18.1 |
| 3,107,425 | 10/1963 | Rentz | 30/164.9 |
| 3,353,273 | 11/1967 | Sicking et al. | 33/18.1 |
| 3,384,965 | 5/1968 | Sicking | 33/18.1 |
| 3,564,712 | 2/1971 | Davis | 33/18.1 |
| 3,753,384 | 8/1973 | Anfindsen | 33/181.1 |
| 3,818,597 | 6/1974 | Schmied | 33/18.1 |
| 4,805,312 | 2/1989 | Dätwyler | 33/18.1 |
| 5,094,134 | 3/1992 | Mizukoshi | 33/18.1 |

*Primary Examiner*—G. Bradley Bennett
*Attorney, Agent, or Firm*—Mallinckrodt & Mallinckrodt

[57] ABSTRACT

An improved stylus assembly for replacing state of the art compressed air powered scribing tools, said stylus stem and point being monolithic and capable of operation indefinitely without failure of the stem, requiring only infrequent sharpening of the scribing tip.

12 Claims, 2 Drawing Sheets

SCRIBING TOOL

BACKGROUND OF THE INVENTION

1. Field

The field of the invention is stylus designs for handheld pneumatic scribers.

2. Prior Art

The prior art of hand-held pneumatic scribing devices is exemplified by the air scribe of FIGS. 1–7. (Prior art), having an outer shell housing 11, also serving as a handle, and a reciprocating piston 12 operated by compressed air provided from a flexible hose 13. The sliding piston is propelled into reciprocating motion by air from hose 13 provided through passages 14. The piston has passages therein, not shown, which are opened or closed according to the piston position to cause the piston to rapidly reciprocate, striking anvil end 15 of stylus assembly 16 repeatedly.

O-rings 17 are utilized between flange 18 of stylus assembly 16 and a shoulder 19 of a stylus holding bushing 20 pressed into the open end of the handle portion of outer housing 11. The O-rings 17, compressed when the stylus assembly 16 is struck by the piston 12, act as a spring to return the stylus assembly toward the withdrawing piston. In the prior art assembly, the stylus holding bushing 20 may also comprise a pair of ball bearings 22 held in place by sleeve 23 rotated to position one of the ball bearings into contact with a rotation restraining flat area provided upon a version of the stylus having a chisel-like end or the like. (FIG. 7, PRIOR ART) In the present inventive stylus/bushing 10, however, the ball bearings are not needed and the bushing 20 is designed accordingly.

The prior art stylus assembly is of very limited longevity. As seen in prior art FIGS. 2*a* and 3, the stylus assembly has only a short, small diameter, working tip 24 of tungsten carbide, press fitted into a bore 25 in the end of reciprocating stem 26. The stylus tip 24 and the end of the stem typically break away within a very few hours of use and often after only a few minutes. The small, very hard, tip element is typically forcibly hammered repeatedly against the bottom 27 of bore 25, creating such high and concentrated stresses that the tip 28 of stem 26 breaks away because of rapid fatigue failure.

Therefore, there exists a definite need to replace the prior art stylus and accompanying bushing with designs having much longer useful lives.

BRIEF SUMMARY OF THE INVENTION

With the foregoing in mind, the longevity of the stylus assembly is greatly increased by providing a monolithic tungsten carbide stem and scribing tip, replacing the separately installed tip which destructively impacts the stem in prior art devices.

Besides providing the improved reciprocating stylus assembly, the invention also provides a stylus holding and guiding bushing which incorporates enlarged spent compressed air discharge slots not easily plugged by fragments from eventual disintegration of the cushioning O-rings after protracted use.

The inventive stylus-bushing assembly also allows selection of styli length for greater or less reach, the longer styli being provided with more elongate bushings with longer supporting channels. Compatibility with the scriber bodies is maintained by using identically dimensioned portions which mate with the scribe handle.

The inventive stylus support bushing provides a circular bore in which the stylus reciprocates, giving greater support and less wear to the stylus than does the hexagonal bore provided in the state of the art bushing.

Thus, the inventive stylus and stylus bushing combination provide much needed increase in useful operating life.

BRIEF DESCRIPTION OF THE DRAWINGS

In the drawings, which represent the best mode presently contemplated for carrying out the invention.

DETAILED DESCRIPTION OF ILLUSTRATED EMBODIMENT

Figure 8:
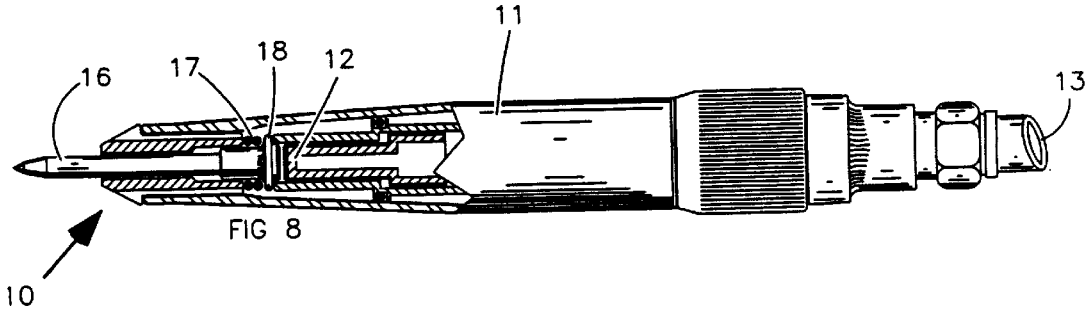
Figure 8A:
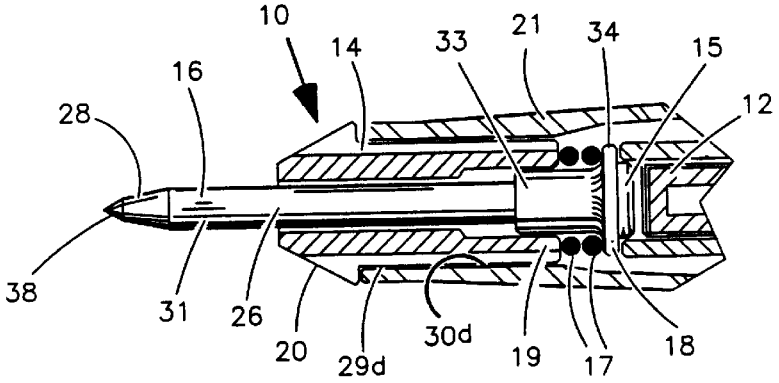
Figure 9:
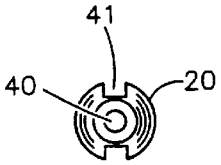
Figure 10:
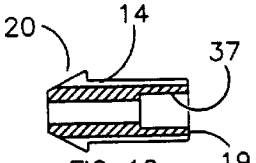
FIG. 10 is a cross sectional view of the bushing shown in FIG. 9, FIG. 11 a cross sectional view of the inventive stylus assembly having the monolithic stem and scribing tip of high impact tungsten, drawn to the scale of FIG. 8, and FIG. 12 a cross sectional view of an inventive stylus-bushing assembly installed within the body of a state of the art scribing tool, partially cut away to show the structure of the lengthened stylus-bushing assembly, drawn to the scale of FIG. 8.
Figure 11:
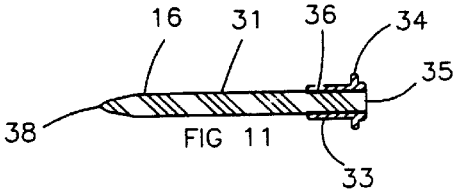

The inventive stylus-bushing assembly 10 is shown in FIGS. 8 and 8*a* installed within the open end of the handle portion 21 of housing 11 of a prior art pneumatic scribing tool. Outside diameter 29*d* of stylus bushing 20 of stylus assembly 10 is sized for press fitting within inside diameter 30*d* of handle portion 21 of outer shell housing 11. (FIGS. 8*a* and 9)

A reciprocating piston 12 is impelled first in one direction and then in the other within housing 11 by pressurized air provided through hose 13. The propelling air is directed through passages 14. Air passages in piston 12, not shown, alternately direct the air to impel the piston 12 to strike and withdraw from anvil end 15 of stylus assembly 16.

The stylus assembly 16 of the inventive stylus-bushing assembly 10 comprises an elongate, constant diameter stem portion 31 monolithic with a tapered scriber tip portion 28 made from a single piece of standard high impact grade solid tungsten carbide.

An open-ended steel sleeve 33 with an integral flange 34 is secured about the stylus stem 31 at its blunt end 35 by silver solder 36. End 35 of sleeve 33 is flush with blunt, piston impacted, end 35 of stylus stem 31. The outer surface of sleeve 33 reciprocates within a counter bore 37 in bushing 20, so that the stylus is restrained from falling from the scribing tool. Flange 34 retains resilient O-rings 17, which absorb the impact of the repeatedly hammering piston 12, reducing tool vibration, and also urge stylus assembly 16 toward its starting position.

Because the stylus stem 31 is of substantial diameter (in the neighborhood of ⅛ inches), it is inherently strong enough to resist breaking and any substantial damage to any part, excepting normal wear of scribing tip 38 during operation. Also, unlike prior art stylus designs there is no separate small, hard stylus tip member 24 of tungsten carbide within a bore in a steel stylus stem 26. This prior art combination leads to inevitable stress concentrations from the repeated impacting of the bottom 27 of the bore 25 in steel stylus stem 26, almost as if the stylus stem itself is being scribed. Failure of the state of the art stylus assembly 16 in fact typically occurs in the counter bored end of the stem. Life of this prior art stylus assembly is typically very short, often so short as to be practically unusable, lasting only a few minutes, and at the most only a few hours of use.

Figure 1:
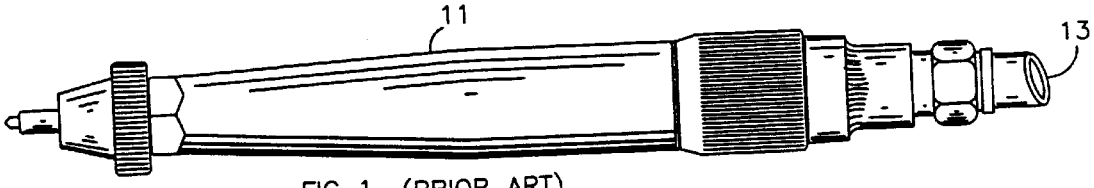
FIG 1 (PRIOR ART)
FIG. 1 is a side view of a state of the art scribing tool, drawn to a somewhat enlarged scale, FIG. 2 a cross sectional view of the scribing tool of FIG. 1, drawn to the same scale, FIG. 2*a* a fragment of the air scribe of FIG. 2, drawn to a larger scale than FIG. 2, FIG. 3 a view of the stylus assembly of the state of the art scribing tool, drawn to the scale of FIG. 2, FIG. 4 a cross sectional view of the state of the art bushing of FIG. 2 with a stylus installed therein, drawn to the scale of FIG. 2, FIG. 5 a cross sectional view of the state of the art bushing drawn to the scale of FIG. 2, FIG. 6 an end view of the state of the art bushing, showing the air discharge slots carried thereby, drawn to the scale of FIG. 2, FIG. 7 a cross sectional view of the state of the art bushing-stylus assembly, wherein the stylus has a chisel-like working head, drawn to the scale of FIG. 2, FIG. 8 a side view of the inventive scribing assembly, being cut away to show the inventive bushing and stylus, drawn to the scale of FIG. 2, FIG. 8*a*. a fragment of the scribing tool of FIG. 8, drawn to an enlarged scale, FIG. 9 an end view of the bushing of the inventive stylus-bushing assembly, showing the improved air discharge slots, drawn to the scale of FIG. 8.
Figure 2:
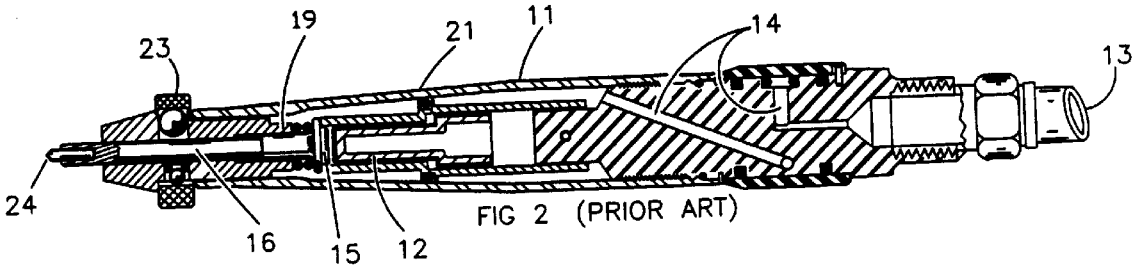
FIG 2 (PRIOR ART)
Figure 2A:
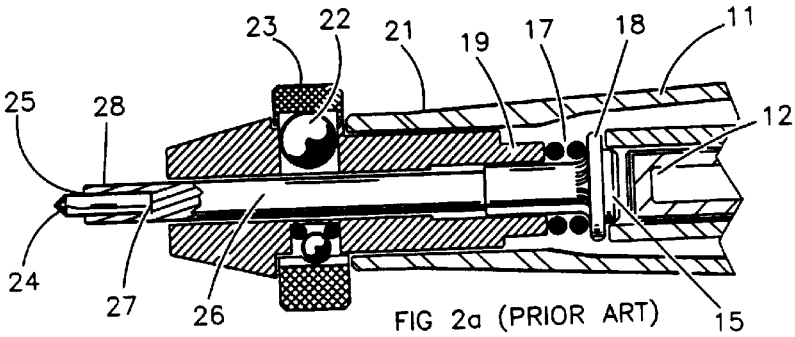
FIG 2a (PRIOR ART)
Figure 3:
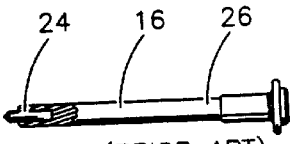
FIG 3 (PRIOR ART)
Figure 4:
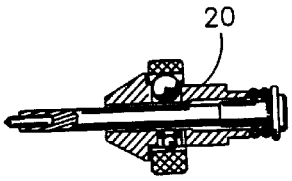
FIG 4 (PRIOR ART)
Figure 5:
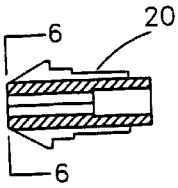
FIG 5 (PRIOR ART)
Figure 6:
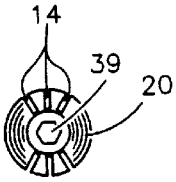
FIG 6 (PRIOR ART)
Figure 7:
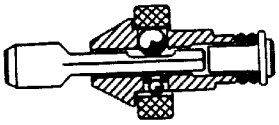
FIG 7 (PRIOR ART)

Further, the stylus mounting bushing 20 is significantly improved over the prior art bushing 20. The inventive bushing 20 provides a circular bore 40 (FIG. 9) therethrough to accept the stylus stem 31, whereas the prior art device requires the stylus stem to reciprocate with less support within a hexagonal bore 39. (Prior Art FIGS. 5 and 6)

The very narrow compressed air discharge slots 14 of the prior art bushing 20 (Prior Art FIG. 5) are rapidly plugged upon fatigue induced fragmentation of the O-rings 17 after a period of operation. In the inventive bushing 20, a single pair of diametrically opposed air exhaust slots 41 (FIG. 9) are sized to in total have sufficient flow area for exhaust of the spent air while avoiding use of narrow passages such as provided by slots 14 of the exemplary prior art scribe design. This wider air exhaust slots permits the expulsion of bits of O-ring material of substantial size without plugging, so that operation time of the stylus without disassembly and cleaning of the slots is substantially extended.

The prior art bushing and stylus assembly 10 is easily removed from the scribing tool, by first unthreading the handle portion 21, along with prior art bushing 20 and stylus assembly 16, then pressing bushing and stylus from the handle. The inventive bushing 20 may then be pressed into the handle, to receive the inventive stylus assembly 16. Handle 21 may then be screwed back onto the scribing tool.

Figure 12:
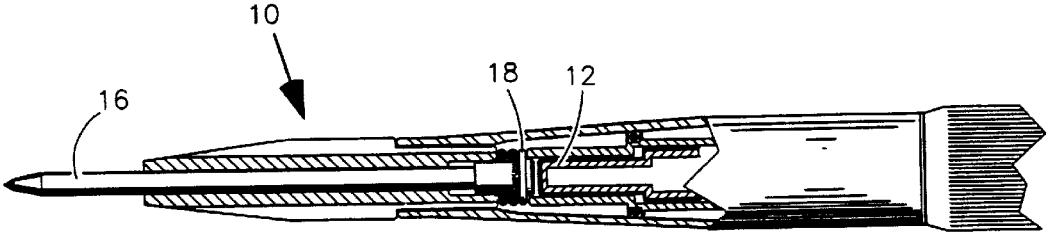

To provide greater reach to the scribing tool, bushing 20 may be constructed of extended length to provide support for a longer stylus. (FIG. 12) Lengths up to 3 inches can be accommodated, as well as the normally used standard 1½ inch length. The longer stylus reach may be useful for archeologists for chipping rock from fossil skull cavities, for example. It may also be used to clean castings of adhering sand and the like.

The inventive apparatus may be embodied in other specific forms without departing from the spirit or essential characteristics thereof. The present apparatus is therefore to be considered illustrative and not restrictive, the scope of the invention being indicated by the appended claims rather than by the foregoing description and all changes which come within the meaning and range of equivalency of the claims are therefore intended to be embraced therein.

What is claimed and desired to be secured by United States Letters Patent is:

1. A stylus and bushing assembly for use with a pneumatic scribing tool of the type which includes an elongate tubular housing, a core member which extends into one end of the housing and which includes compressed air directing passages therethrough, a connector mounted to the exposed end of the core member for attaching a compressed air supply hose, a manually operated compressed air valve ring radially disposed about the core member for regulating the flow of compressed air through the core member, one or more resilient stylus returning O-rings, and a piston and cylinder operatively connected to the core member within the housing, which piston is powered by the compressed air and guided to longitudinally reciprocate therein, comprising:

a bushing comprising a member having a cylindrical portion sized to fit into and which attaches to the end of the tubular housing opposite the core member, said bushing having a longitudinally extending, generally circular hole which extends completely through said bushing; and a stylus comprising an elongate solid, generally cylindrical member made of high impact grade tungsten carbide, having a first end portion which is of such size as to fit within the hole and which contacts the piston for reciprocal motion therein during use and a second end portion having a pointed scribing tip.

2. A stylus and bushing assembly according to claim 1, wherein:

the hole through the bushing has an enlarged portion at the end thereof adjacent the piston; and the stylus further comprises a generally cylindrical sleeve which closely fits about and which is secured to the first end of the stylus member, said sleeve being of such size as to permit reciprocal motion of said stylus with sleeve within the enlarged portion of the hole through said bushing, the sleeve having an annular flange at an end thereof adjacent said first end portion of said stylus member sized to retain the O-rings about said cylindrical sleeve between said flange and the end of said bushing inside the housing.

3. A stylus and bushing assembly according to claim 2, wherein the bushing has a pair of longitudinally extending, outwardly opening, diametrically opposed, compressed air discharge slots which extend the full length of said bushing and of such size as to allow exhaust of spent compressed air without becoming plugged with pieces of O-ring as such O-rings disintegrate during use.

4. A stylus and bushing assembly according to claim 1, wherein the cylindrical portion of the bushing attaches to the end of the housing by means of press fitting thereinto.

5. A stylus and bushing assembly according to claim 1, wherein the stylus member is of a constant diameter except for the pointed scribing tip thereof.

6. A stylus for use with a pneumatic scribing tool of the type which includes an elongate tubular housing, a core member which extends into one end of the housing and which includes compressed air directing passages therethrough, a connector mounted at to the exposed end of the core member for attaching a compressed air supply hose, a manually operated compressed air valve ring radially disposed about the core member for regulating the flow of compressed air through the core member, one or more resilient stylus returning O-rings, a piston and cylinder operatively connected to the core member within the housing, which piston is powered by the compressed air and guided to longitudinally reciprocate therein, and a bushing having a cylindrical portion sized to fit into and which attaches to the end of the tubular housing opposite the core member, the bushing having a longitudinally extending, generally circular hole which extends completely through the bushing, the stylus comprising an elongate solid, generally cylindrical member made of high impact grade tungsten carbide, having a first end portion which is of such size as to fit within the hole and which contacts the piston for reciprocal motion therein during use and a second end portion having a pointed scribing tip.

7. A stylus according to claim 6, wherein the stylus further comprises a generally cylindrical sleeve which closely fits about and which is secured to the first end of the stylus member, said sleeve being of such size as to permit reciprocal motion of the stylus with sleeve within the enlarged portion of the hole through the bushing, said sleeve having an annular flange at an end thereof adjacent said first end portion of said stylus member sized to retain the O-rings about said cylindrical sleeve between said flange and the end of the bushing inside the housing.

8. A stylus according to claim 6, wherein the stylus member is of a constant diameter except for the pointed scribing tip thereof.

9. A bushing for use with a pneumatic scribing tool of the type which includes an elongate tubular housing, a core member which extends into one end of the housing and which includes compressed air directing passages therethrough, a connector mounted at to the exposed end of the core member for attaching a compressed air supply hose, a manually operated compressed air valve ring radially disposed about the core member for regulating the flow of compressed air through the core member, one or more resilient stylus returning O-rings, a piston and cylinder operatively connected to the core member within the housing, which piston is powered by the compressed air and guided to longitudinally reciprocate therein, and a stylus comprising an elongate solid, generally cylindrical member having a first end portion which contacts the piston for reciprocal motion therein during use and a second end portion having a pointed scribing tip, the bushing comprising a member having a cylindrical portion sized to fit into and which attaches to the end of the tubular housing opposite the core member, said bushing having a longitudinally extending, generally circular hole which extends completely through said bushing of such size as to permit reciprocal motion of the stylus therein.

10. A bushing according to claim 9, wherein the hole through the bushing has an enlarged portion at the end thereof adjacent the piston of such size as to permit reciprocal motion of a stylus with sleeve therein, the sleeve being generally cylindrical and which closely fits about and which is secured to the first end portion of the stylus member.

11. A bushing according to claim 9, wherein a pair of longitudinally extending, outwardly opening, diametrically opposed, compressed air discharge slots extend the full length of said bushing being of such size as to allow exhaust of spent compressed air without becoming plugged with pieces of O-ring as such O-rings disintegrate during use.

12. A bushing according to claim 9, wherein the cylindrical portion of the bushing attaches to the end of the housing by means of press fitting thereinto.

* * * * *